US007686073B1

(12) United States Patent
Reynolds

(10) Patent No.: US 7,686,073 B1
(45) Date of Patent: Mar. 30, 2010

(54) TUBING STRING

(75) Inventor: Jay Reynolds, Oil City, LA (US)

(73) Assignee: Angel Petroleum Technologies, LLC, Vivian, LA (US)

( * ) Notice: Subject to any disclaimer, the term of this patent is extended or adjusted under 35 U.S.C. 154(b) by 185 days.

(21) Appl. No.: 11/982,472

(22) Filed: Nov. 2, 2007

Related U.S. Application Data

(60) Provisional application No. 60/857,835, filed on Nov. 10, 2006.

(51) Int. Cl.
*E21B 19/22* (2006.01)

(52) U.S. Cl. ..... 166/65.1; 166/242.1

(58) Field of Classification Search ..... 166/65.1, 166/242.1, 105
See application file for complete search history.

(56) References Cited

U.S. PATENT DOCUMENTS

| | | | | |
|---|---|---|---|---|
| 3,212,582 | A | 10/1965 | Brown | 166/242 |
| 4,134,334 | A | 1/1979 | Payne et al. | 417/545 |
| 4,452,314 | A | 6/1984 | Zion | 166/378 |
| 4,597,688 | A | 7/1986 | Pagan | 403/265 |
| 5,018,583 | A | 5/1991 | Williams | 166/385 |
| 5,236,036 | A | 8/1993 | Ungemach et al. | 166/77 |
| 5,469,916 | A | 11/1995 | Sas-Jaworski et al. | 166/64 |
| 5,913,337 | A * | 6/1999 | Williams et al. | 138/125 |
| 6,352,216 | B1 * | 3/2002 | Coats | 242/608.4 |
| 6,863,937 | B2 | 3/2005 | Terry et al. | 175/92 |
| 6,923,273 | B2 | 8/2005 | Terry et al. | 175/45 |
| 2004/0134555 | A1 * | 7/2004 | Powell et al. | 138/141 |
| 2007/0207046 | A1 * | 9/2007 | Du et al. | 417/423.3 |

* cited by examiner

*Primary Examiner*—William P Neuder
(74) *Attorney, Agent, or Firm*—R. Keith Harrison

(57) ABSTRACT

A spiral wiring tubing string is disclosed. An illustrative embodiment of the spiral wiring tubing string includes a tubing core having a tubing interior, an outer tubing layer encircling the tubing core and at least one wiring cable extending through and along the outer tubing layer. A fluid production system is also disclosed.

17 Claims, 14 Drawing Sheets

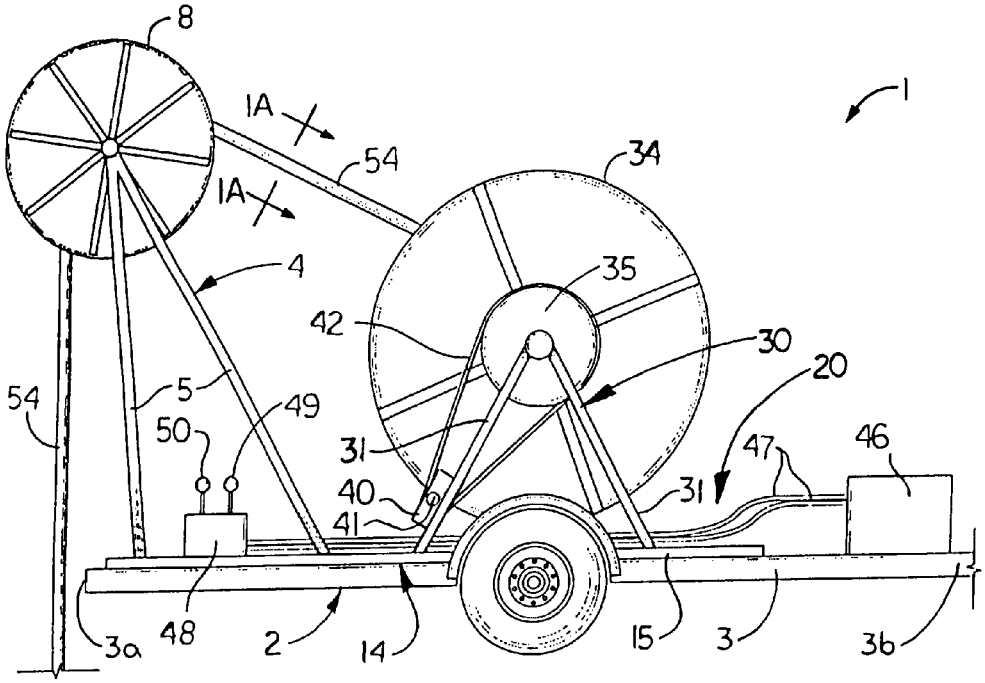
FIG. 1
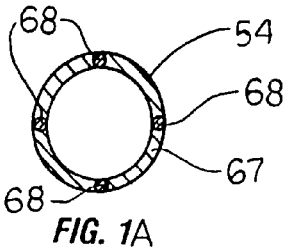
FIG. 1A
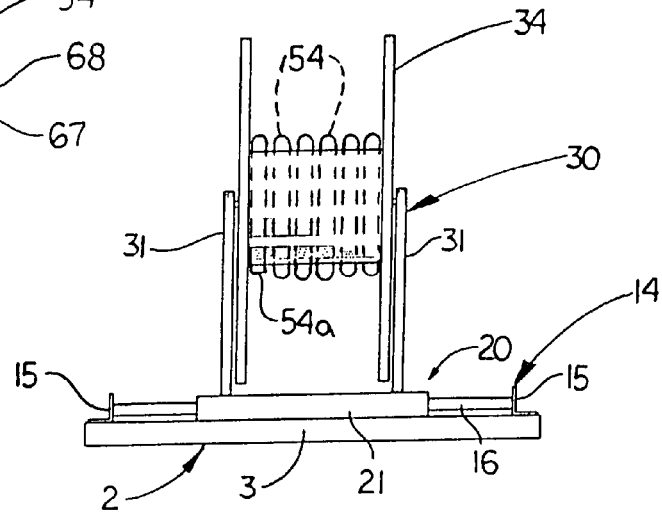
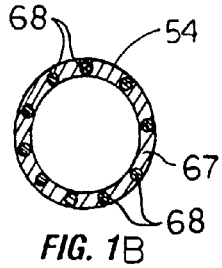
FIG. 1B
FIG. 2

TUBING STRING

CROSS-REFERENCE TO RELATED APPLICATIONS

This application claims the benefit of U.S. Provisional patent application No. 60/857,835, filed Nov. 10, 2006 and entitled "Hydrocarbon Production System".

FIELD

The present disclosure relates to systems for extracting fluids such as hydrocarbons and potable water, for example, from wells. More particularly, the present disclosure relates to a tubing string which is suitable for a fluid production system and method which facilitates the expeditious extraction of a fluid such as hydrocarbons or potable water, for example, from one or more wells due to decreased time required for well installation and removal as well as transport among the wells and a fluid production system and method which utilize a tubing string.

BACKGROUND

Hydrocarbons are typically initially produced from an oil or gas formation using the natural downhole pressure of the hydrocarbons in a well bore. Over time, however, the downhole pressure of the hydrocarbons is typically insufficient to lift the hydrocarbons to the surface of the earth. Therefore, sucker rod pumps are commonly used to extract hydrocarbons from the well by admitting fluid from the formation into a production tubing and then lifting the fluid to the surface.

A typical conventional sucker rod pump includes a pump barrel. A sucker rod reciprocates in the pump barrel and is connected to a hydrocarbon storage facility. A standing valve is provided in the lower end portion of the pump barrel, and a traveling valve is provided on the sucker rod. A chamber is provided in the pump barrel between the standing valve and the traveling valve. On the upstroke of the sucker rod, the standing valve opens to facilitate flow of the fluid from the wellbore and into the chamber while the traveling valve closes. On the downstroke of the sucker rod, the standing valve closes and the traveling valve opens to facilitate flow of the fluids from the chamber, through the sucker rod to the storage facility.

The conventional sucker rod pump is mechanically complex, and therefore, requires extensive time and manpower to install and service. When hydrocarbons have been depleted from a well, sucker rod pumps require extensive time and manpower to disassemble at the depleted well, transport and install at a second well. Further, sucker rod pumps typically produce through steel tubing which is subject to corrosion and requires expensive corrosion inhibition chemical treatment to extend its service life. Every reciprocating stroke of the sucker rod assembly results in two wear strokes at the interior surface of the production tubing.

SUMMARY

The present disclosure is generally directed to a spiral wiring tubing string. An illustrative embodiment of the spiral wiring tubing string includes a tubing core having a tubing interior, an outer tubing layer encircling the tubing core and at least one wiring cable extending along the outer tubing layer.

The present invention is further generally directed to a fluid production system which utilizes a spiral wiring tubing string. An illustrative embodiment of the fluid production system includes a tubing transport, installation and removal apparatus comprising a trailer having a wheeled trailer frame, a tubing spool carried by the trailer frame and a tubing reel carried by the trailer frame in spaced-apart relationship with respect to the tubing spool. A tubing string is wound on the tubing spool and extends over the tubing reel tubing string. An illustrative embodiment of the tubing string includes a tubing core having a tubing interior, an outer tubing layer encircling the tubing core and at least one wiring cable extending along the outer tubing layer. A pump is provided on the tubing string and a pump motor drivingly engages the pump.

BRIEF DESCRIPTION OF THE DRAWINGS

The invention will now be described, by way of example, with reference to the accompanying drawings, in which:

FIG. 1 is a side view of an illustrative embodiment of a transport, installation and removal apparatus of the fluid production system, with a tubing string (partially in section) extending from a tubing spool element and over a tubing reel element of the apparatus;

FIG. 1A is a cross-sectional view of the tubing string, taken along section lines 1A-1A in FIG. 1;

FIG. 1B is a cross-sectional view of an alternative embodiment of the tubing string;

FIG. 2 is a front view of a tubing spool and spool carriage elements of the transport, installation and removal apparatus;

DETAILED DESCRIPTION

Figure 3:
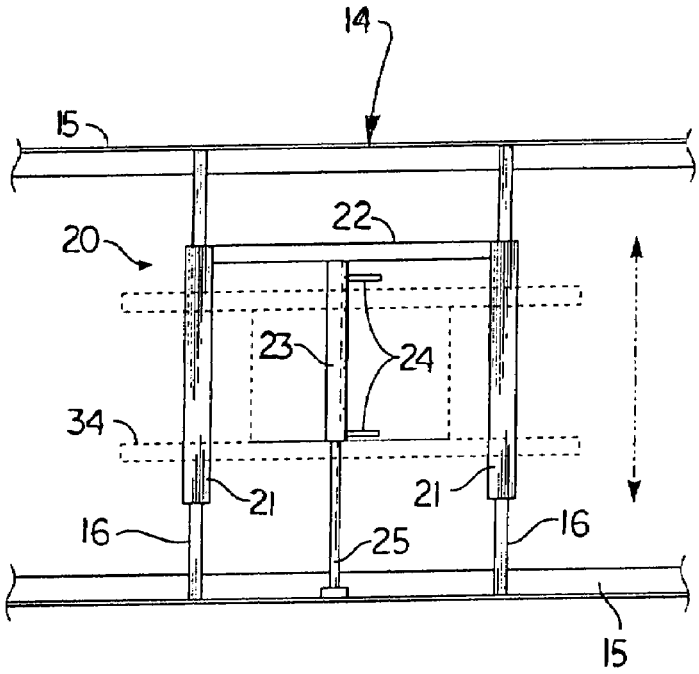
FIG. 3 is a top view of the spool carriage element of the transport, installation and removal apparatus, with the tubing spool element (indicated in phantom) provided on the spool carriage.

Referring initially to FIGS. 1-4 and 18 of the drawings, a tubing transport, installation and removal apparatus, hereinafter apparatus, of the fluid production system is generally indicated by reference numeral 1 in FIG. 1. The apparatus 1 includes a trailer 2 having a generally elongated, rectangular, wheeled trailer frame 3 (shown partially in section). The trailer frame 3 has a first end 3*a* and a second end 3*b*. A reel frame 4 is provided on the trailer 2, typically adjacent to the first end 3*a* of the trailer frame 3. The reel frame 4 typically includes two pairs (one of which is illustrated) of converging elongated reel frame members 5 which extend from the trailer frame 2. A tubing reel 8 is rotatably mounted on the reel frame 4 for purposes which will be hereinafter described.

A spool base frame 14 is provided on the trailer frame 3 of the trailer 2. As illustrated in FIG. 3, the spool base frame 14 typically includes a pair of generally elongated, parallel, spaced-apart base frame members 15 each of which is bolted, welded and/or attached to the trailer frame 3 using any suitable technique known by those skilled in the art. A pair of generally elongated, parallel, spaced-apart carriage frame members 16 extends between the base frame members 15, of the spool base frame 14.

A spool carriage 20 is mounted for transverse displacement on the carriage frame members 16, between the base frame members 15 of the spool base frame 14. The spool carriage 20 typically includes a pair of carriage sleeves 21 which receive and are slidably mounted on the respective carriage frame members 16. An elongated cross member 22 extends between and connects the carriage sleeves 21 to each other. A hydraulic cylinder 23 extends from the cross member 22, between the carriage sleeves 21. A pair of spaced-apart hydraulic connections 24 communicates with the hydraulic cylinder 23 for connection to a cylinder distribution line 47*a* (FIG. 18) and a cylinder return line 47*b*, respectively. A piston 25 is selectively extendable from and retractable into the hydraulic cylinder 23, responsive to the input of hydraulic fluid into the hydraulic cylinder 23 through the appropriate hydraulic connection 24. The extending or distal end of the piston 25 engages a base frame member 15 of the spool base frame 14. Accordingly, responsive to extension of the piston 25 from the hydraulic cylinder 23 and retraction of the piston 25 into the hydraulic cylinder 23, the spool carriage 20 slides bidirectionally on the carriage frame members 16, between the base frame members 15 of the spool base frame 14, as indicated by the double-headed arrow in FIG. 3, in transverse relationship with respect to the longitudinal axis of the trailer frame 3 (FIG. 1).

As further illustrated in FIG. 1, a spool frame 30 is provided on the trailer frame 3. The spool frame 30 typically includes two pairs (one of which is illustrated) of converging elongated spool frame members 31 which extend from the respective carriage sleeves 21 (FIG. 3) of the spool carriage 20. A tubing spool 34 includes a spool huh 35 which is rotatably mounted on the spool frame 30. A hydraulic spool motor 41 drivingly engages the spool hub 35 of the tubing spool 34 to facilitate rotation of the tubing spool 34 in a selected clockwise or counterclockwise direction on the spool frame 30. The spool motor 41 may be provided in any location which is suitable for the purpose. For example, in some embodiments of the apparatus 1, a motor mount bracket 40 is provided on one of the spool frame members 31 of the spool frame 30, as illustrated in FIG. 1, and the spool motor 41 is provided on the motor mount bracket 40. A spool drive chain 42 is drivingly engaged by the spool motor 41 and drivingly engages the spool huh 35. Accordingly, by operation of the spool motor 41, the spool drive chain 42 rotates the tubing spool 34 on the spool frame 30 in a selected clockwise or counterclockwise direction for purposes which will be hereinafter described.

Figure 18:
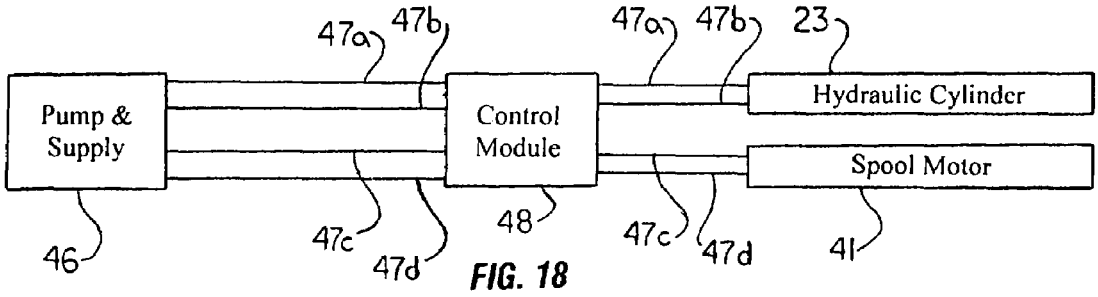
FIG. 18 is a schematic diagram which illustrates a typical hydraulic control system of the transport, installation and removal apparatus of an illustrative embodiment of the fluid production system.

As further illustrated in FIG. 1, a hydraulic pump and supply mechanism 46 and a control module 48 are provided on the trailer frame 3. Hydraulic lines 47 connect the hydraulic pump and supply mechanism 46 to the control module 48. Hydraulic lines 47 further connect the control module 48 to the hydraulic connections 24 (FIG. 3) of the spool carriage 20 and to the spool motor 41 (FIG. 1) which drivingly engages the tubing spool 34. As illustrated in FIG. 18, the hydraulic lines 47 typically include a cylinder distribution line 47*a* which connects the pump and supply mechanism 46 to the control module 48 and the control module 48 to the inlet of the hydraulic cylinder 23; a cylinder return line 47*b* which connects the outlet of the hydraulic cylinder 23 to the control module 48 and the control module 48 to the pump and supply mechanism 46; a motor distribution line 47*c* which connects the pump and supply mechanism 46 to the control module 48 and the control module 48 to the inlet of the spool motor 41; and a motor return line 47*d* which connects the outlet of the spool motor 41 to the control module 48 and the control module 48 to the pump and supply mechanism 46.

As illustrated in FIG. 1, the control module 48 typically includes a spool carriage control lever 49 and a spool motor control lever 50. Accordingly, by manipulation of the spool carriage control lever 49 of the control module 48 in a first direction, hydraulic fluid (not illustrated) is distributed from the hydraulic pump and supply mechanism 46, through the cylinder distribution line 47*a* (FIG. 18) and the control module 48 to the hydraulic cylinder 23 (FIG. 3) of the spool carriage 20, and back to the pump and supply mechanism 46 through the cylinder return line 47*b*, to extend the piston 25 from the hydraulic cylinder 23 and facilitate travel of the spool carriage 20 in a first direction on the carriage frame members 16. By manipulation of the spool carriage control lever 49 in a second direction, hydraulic fluid is distributed from the hydraulic pump and supply mechanism 46, through the cylinder return line 47*b* and control module 48 to the hydraulic cylinder 23, and back to the hydraulic pump and supply mechanism 46 through the cylinder distribution line 47*a*, to retract the piston 25 back into the hydraulic cylinder 23 and facilitate travel of the spool carriage 20 in a second direction on the carriage frame members 16. By manipulation of the spool motor control lever 50 of the control module 48 in a first direction, hydraulic fluid is distributed from the hydraulic pump and supply mechanism 46, through the motor distribution line 47*c* and control module 48 to the spool motor 41, and back to the pump and supply mechanism 46 through the motor return line 47*d*, to facilitate rotation of the tubing spool 34 in a selected clockwise or counterclockwise direction on the spool frame 30. By manipulation of the spool motor control lever 50 of the control module 48 in a second direction, hydraulic fluid is distributed from the hydraulic pump and supply mechanism 46, through the motor return line 47*d* and control module 48 to the spool motor 41, and back to the pump and supply mechanism 46 through the motor distribution line 47*c*, to facilitate rotation of the tubing spool 34 in the opposite selected clockwise or counterclockwise direction on the spool frame 30.

Figure 4:
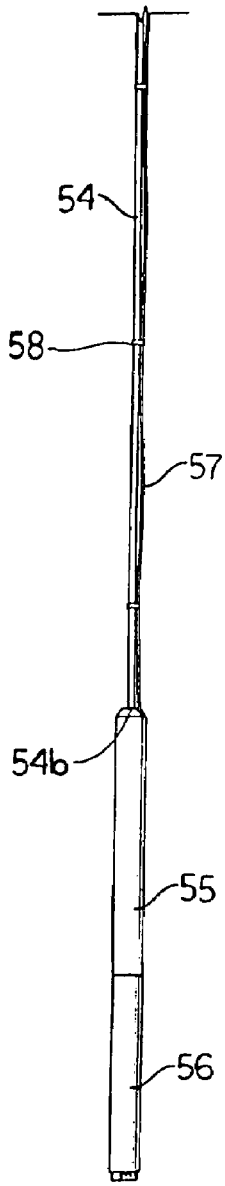
FIG. 4 is a side view of a segment of the tubing string (partially in section), with a pump and pump motor provided on the end of the segment of the tubing string.

As illustrated in FIG. 1, a tubing string 54 is normally wound on the tubing spool 34. The tubing string 54 has a proximal end 54*a* (FIG. 2) and a distal end 54*b* (FIG. 4). In typical application of the invention, the tubing string 54 is continuous, flexible and non-metallic and is typically a non-corrosive, flexible plastic. In some embodiments, the tubing string 54 has other characteristics which may include but are not limited to: small minimum bend radius; little or no bend memory; heat tolerance; and resistance to stretching under tensile loads.

Figure 7:
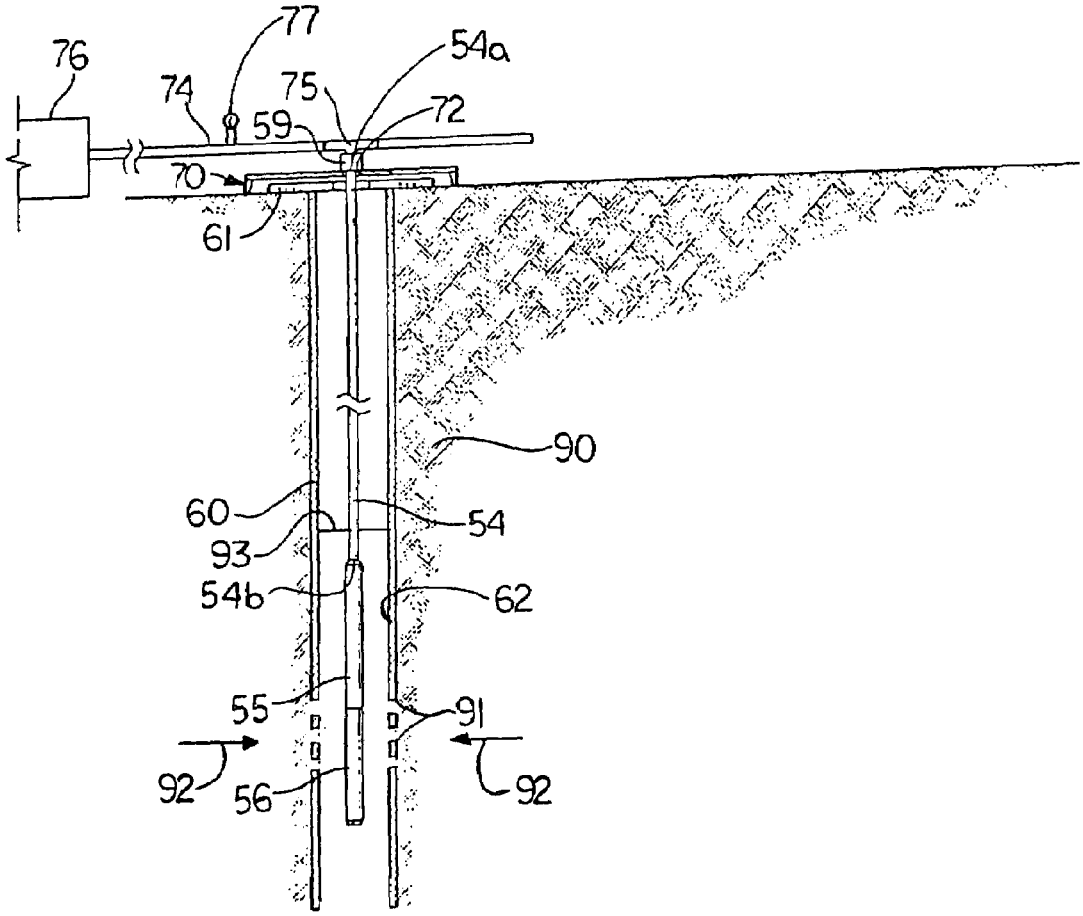
FIG. 7 is a longitudinal sectional view of a well bore, with the tubing string, pump and pump motor installed in the well bore and a flow line attached to the tubing string in the production of fluids from the well bore through the pump, tubing string and flow line, respectively.

In typical application of the apparatus 1, as will be hereinafter described, the tubing string 54 extends from the tubing spool 34 and is trained over the tubing reel 8. The tubing spool 34 is rotated in the counterclockwise direction in FIG. 1 to facilitate dispensing of the tubing string 54 from the tubing spool 34, over the tubing reel 8 and into a subterranean well casing 60 (FIG. 5) preparatory to the production of fluid 92, such as hydrocarbons or potable water, for example, from a well bore 62 in the well casing 60, as illustrated in FIG. 7. The tubing spool 34 is rotated in the clockwise direction in FIG. 1 to facilitate extraction of the tubing string 54 from the well casing 60 and uptake of the tubing string 54 onto the tubing spool 34. During uptake of the tubing string 54 onto the tubing spool 34, the hydraulic cylinder 23 (FIG. 3) is typically operated to move the spool carriage 20, and tubing spool 34 mounted thereon, in a side-to-side motion. This facilitates even layering of the tubing string 54 on the tubing spool 34 during uptake of the tubing string 54 on the tubing spool 34, as illustrated in phantom in FIG. 2.

Figure 14:
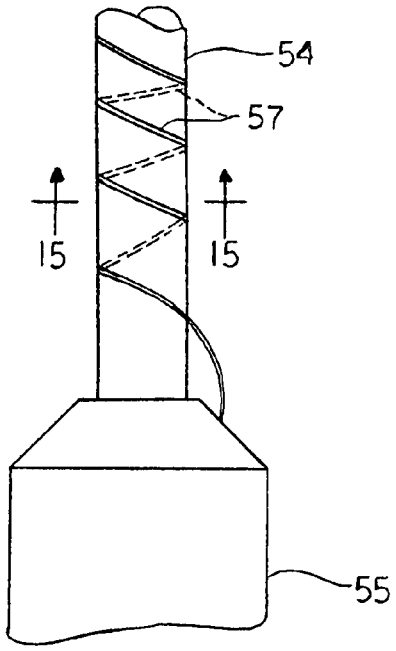
FIG. 14 is a side view, partially in section, of a tubing string and a pump (also in section) connected to the tubing string, more particularly illustrating extension of a pump motor wiring cable along the tubing string in a helical configuration.
Figure 15:
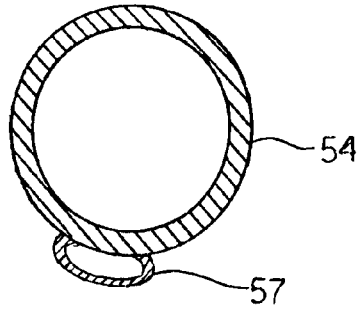
FIG. 15 is a cross-sectional view, taken along section lines 15-15 in FIG. 14, of the tubing string and helical pump motor wiring cable.
Figure 16:
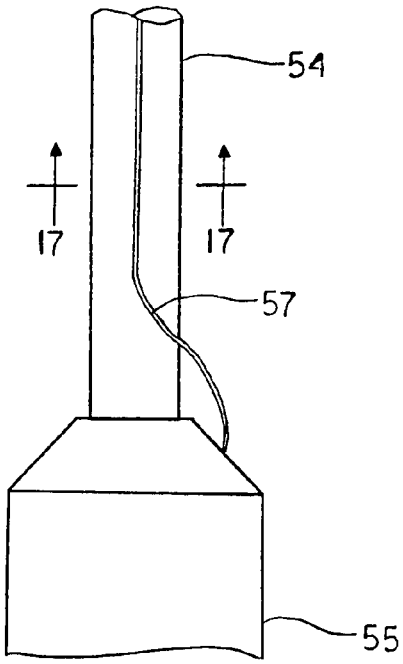
FIG. 16 is a side view, partially in section, of a tubing string and a pump (also in section) connected to the tubing string, more particularly illustrating extension of a pump motor wiring cable along the tubing string in a linear configuration.
Figure 17:
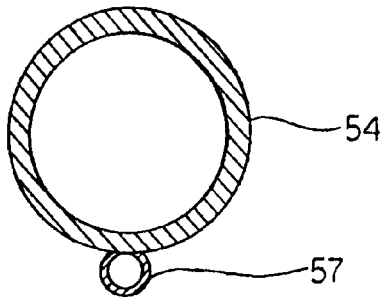
FIG. 17 is a cross-sectional view, taken along section lines 17-17 in FIG. 16, of the tubing string and helical pump motor wiring cable.
Figure 19:
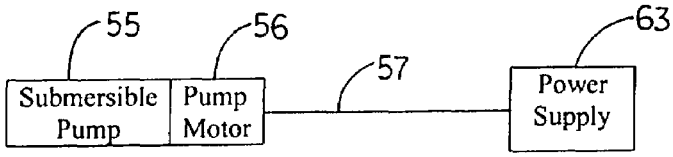
FIG. 19 is a schematic diagram which illustrates a power supply connected to a pump motor and pump elements of the fluid production system.

As illustrated in FIGS. 4, 14-17 and 19 of the drawings, a pump 55, which may be conventional, is provided on the extending or distal end 54*b* of the tubing string 54. The pump 55 may be any type of pump which is provided on the tubing string 54 and is capable of pumping fluids through the tubing string 54. Examples of pumps which are suitable for the purpose include, without limitation, electric and/or mechanical submersible pumps and positive displacement pumps such as progressive cavity pumps. An electric pump motor 56 drivingly engages the pump 55. A pump motor wiring cable 57 is electrically connected to the pump motor 56 and runs along the tubing string 54. As illustrated in FIG. 19, the pump motor wiring cable 57 is connected to a suitable power supply 63, such as a battery provided on the trailer frame 3 of the trailer 2, for example. In some embodiments, multiple cable ties 58 secure the pump motor wiring cable 57 to the tubing string 54 at spaced-apart intervals with respect to each other. In other embodiments, the pump motor wiring cable 57 is fused onto the exterior surface of the tubing string 54, according to the knowledge of those skilled in the art, in a generally external spiral or helical pattern, as illustrated in FIGS. 14 and 15; or in a generally external linear pattern, as illustrated in FIGS. 16 and 17.

Figure 8:
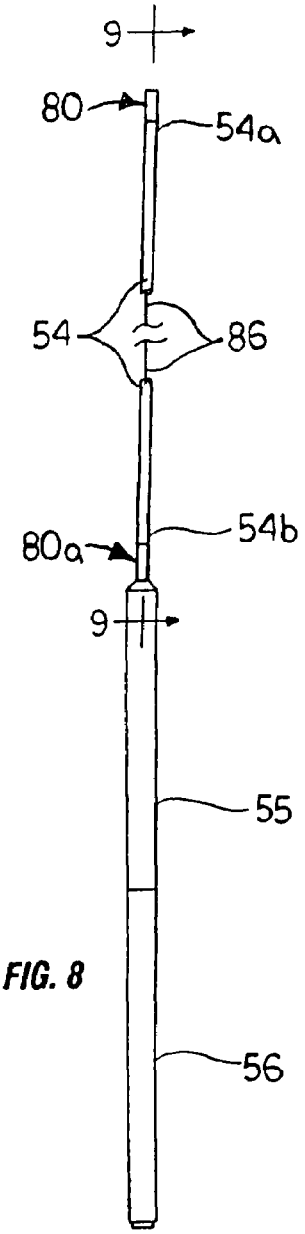
FIG. 8 is a side view of the pump and pump motor, attached to the tubing string and more particularly illustrating a pair of suspension couplings provided on respective ends of the tubing string.
Figure 9:
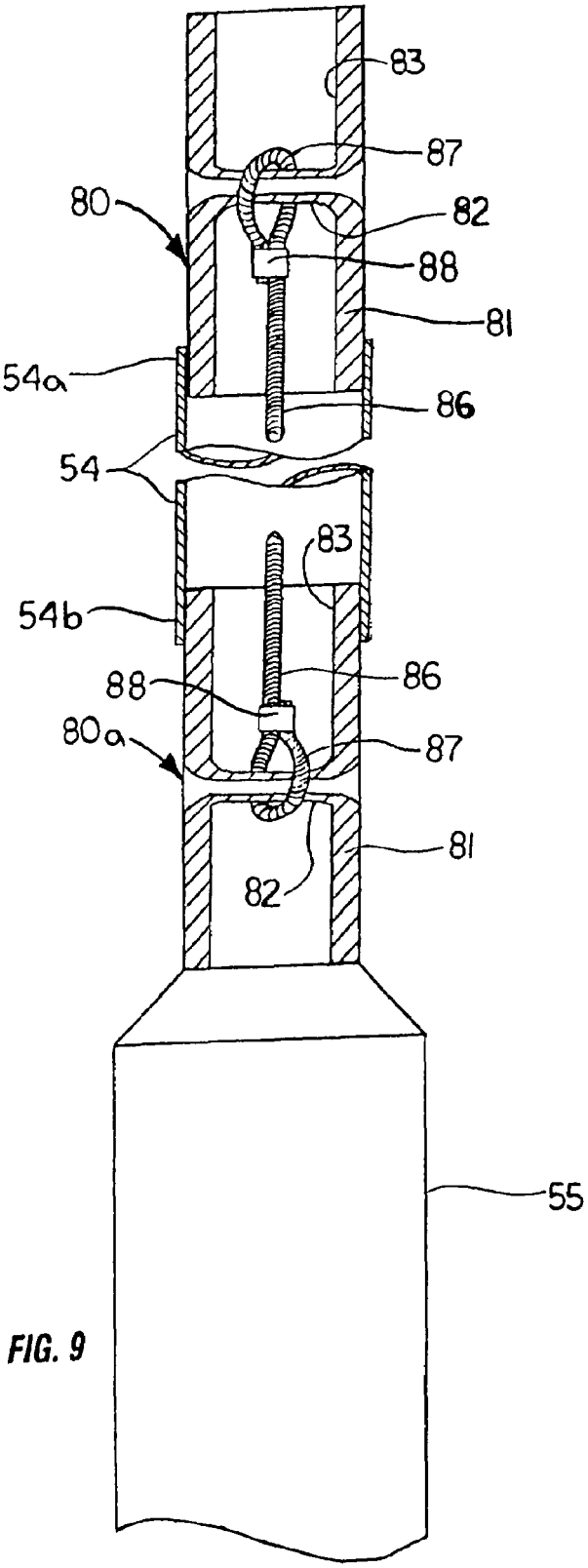
FIG. 9 is a longitudinal sectional view, taken along section lines 9-9 in FIG. 8, more particularly illustrating a reinforcing cable attached to the suspension couplings and extending through the tubing string.

Referring next to FIGS. 8 and 9 of the drawings, in some embodiments, a first suspension coupling 80 is provided on the proximal end 54*a* of the tubing string 54. A second suspension coupling 80*a* connects the pump 55 to the distal end 54*b* of the tubing string 54. The first suspension coupling 80 and the second suspension coupling 80*a* each typically includes a generally elongated, cylindrical coupling wall 81. A coupling bore 83 is defined by the coupling wall 81. A cable attachment member 82 extends from the coupling wall 81 and spans the interior of the coupling bore 83. A reinforcing cable 86 terminates at both ends in a cable loop 87 which is typically secured with a cable stay 88. Each cable loop 87 engages the cable attachment member 82 of the corresponding first suspension coupling 80 and second suspension coupling 80*a*, and the reinforcing cable 86 extends through the interior of the tubing string 54. Accordingly, the reinforcing cable 86 reinforces the tubing string 54 as the tubing string 54 is wound on the tubing spool 34 of the apparatus 1 to prevent excessive stretching and/or breakage of the tubing string 54. In the extraction of fluid 92 from a well bore 62 (FIG. 7), the first suspension coupling 80 is typically coupled to the T-connector 75 to which the flow line 74 (FIG. 7) is connected.

As illustrated in FIG. 1A, in some embodiments multiple reinforcing cables 68 extend through the tubing string wall 67 of the tubing string 54. As illustrated in FIG. 1B, in some embodiments, as many as ten reinforcing cables 68 extend through the tubing string wall 67 of the tubing string 54, throughout substantially the entire length of the tubing string 54. The reinforcing cables 68 may be KEVLAR (trademark) which is cast into the typically thermoplastic resin tubing string wall 67.

Figure 5:
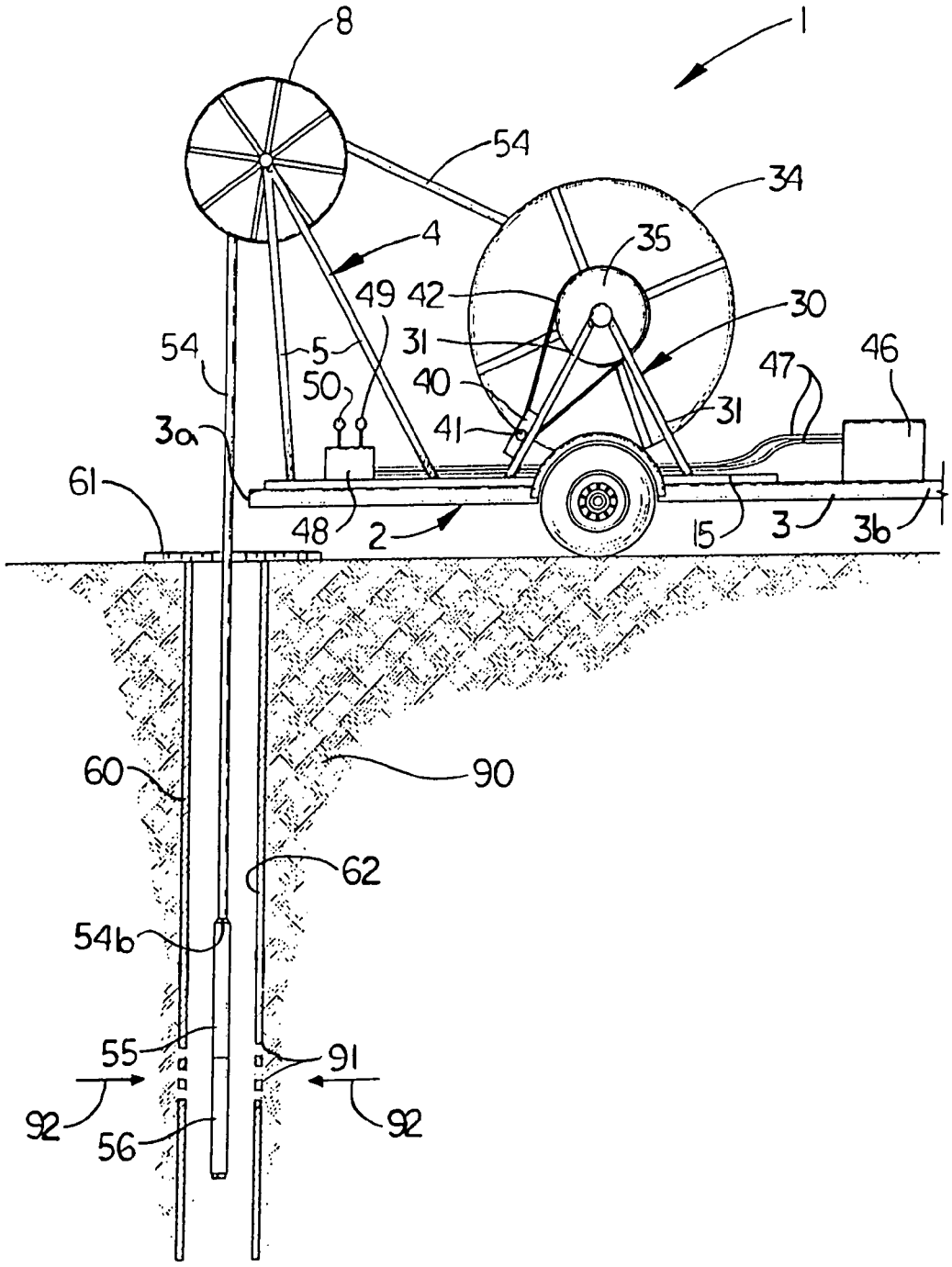
FIG. 5 is a side view of the transport, installation and removal apparatus, more particularly illustrating installation of the tubing string, pump and pump motor in a subterranean well bore preparatory to production of fluids from the well bore.

Referring next to FIGS. 5, 7, 7A and 19 of the drawings, in typical implementation of the fluid production system, a subterranean well casing 60 having a well bore 62 extends adjacent to a formation 90 containing fluid 92, as illustrated in FIG. 5. A well head 61 is provided on the well casing 60, at ground level. Perforations 91 are first made in the well casing 60, adjacent to the formation 90 to facilitate the flow of fluid 92 from the formation 90 and into the well bore 62. The trailer 2 of the apparatus 1 is positioned with the first end 3*a* of the trailer frame 3 adjacent to the well casing 60, as illustrated in FIG. 5, with the tubing reel 8 of the apparatus 1 positioned over the well bore 62. Next, by actuation of the spool motor 41, the tubing spool 34 is rotated in the counterclockwise direction in FIG. 5 to unwind the tubing string 54 from the tubing spool 34, over the tubing reel 8 and lower the pump 55 and pump motor 56 into the well bore 62.

Figure 7A:
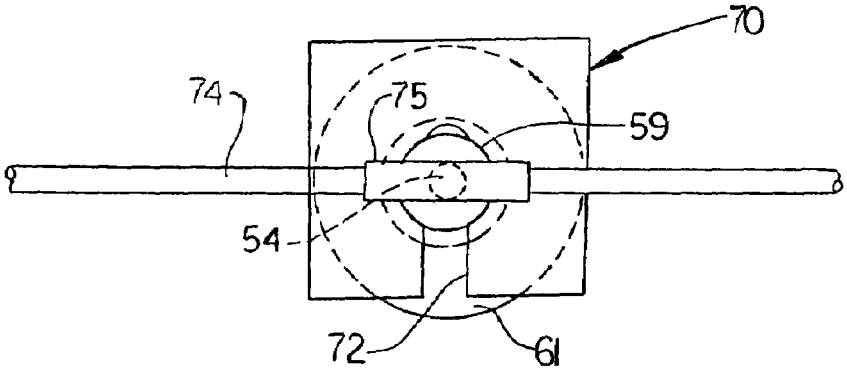
FIG. 7A is a top view of a channel plate, with the tubing string supported through a channel slot in the channel plate and the flow line attached to the tubing string.

When the pump 55 reaches the level of the standing fluid level 93 in the well casing 60, the tubing string 54 may be completely unwound from the tubing spool 34 and may remain tethered to the tubing reel 8, after which the tubing string 54 is detached from the tubing reel 8. As illustrated in FIG. 19, the pump 55 is electrically connected to a suitable power supply 63 which is provided typically on the trailer 2 or at an alternative location. Next, as illustrated in FIG. 7, a tubing collar 59 is fitted on the tubing string 54, at the proximal end 54*a* thereof. A channel plate 70, having an elongated channel slot 72, as illustrated in FIG. 7A, may be placed over the well head 61. The channel slot 72 is narrower than the fitting (not illustrated) upon which the tubing string 54 is suspended. Accordingly, the upper end portion of the tubing string 54 is inserted in the channel slot 72, with the tubing collar 59 resting on the channel plate 70 and the tubing string 54 extending through the channel slot 72. As illustrated in FIGS. 7 and 7A, a T-connector 75 is provided on the proximal end 54*a* of the tubing string 54. A flow line 74 is connected to the T-connector 75, and a collection tank 76 is connected to the flow line 74. By operation of the pump 55, fluid 92 is drawn from the formation 90, through the perforations 91 and into the well bore 62, from which the fluid 92 is drawn through the pump 55, tubing string 54, T-connector 75, flow line 74 and into the collection tank 76, respectively. A pressure gauge 77 may be provided in the flow line 74 to monitor the pressure of fluid flowing through the flow line 74.

When the supply of fluid 92 in the formation 90 has been substantially depleted, the flow line 74 is detached from the T-connector 75; the T-connector 75 and tubing collar 59 are detached from the tubing string 54; and the tubing string 54 is routed over the tubing reel 8 and wound on the tubing spool 34 by clockwise rotation of the tubing spool 34 via actuation of the spool motor 41 of the apparatus 1. As the tubing string 54 is wound on the tubing spool 34, the spool carriage 20 (FIGS. 2 and 3) is typically moved in a side-to-side motion on the carriage frame members 16 by operation of the hydraulic cylinder 23 (FIG. 3). This facilitates uptake of the tubing string 54 on the tubing spool 34 in an orderly and evenly-layered manner, as illustrated in FIG. 2. The tubing string 54, wound on the tubing spool 34, is then transported to another subterranean well casing 60 and installed in the well bore 62, typically as was heretofore described with respect to FIGS. 5, 7 and 7A, preparatory to the production of fluid 92 from the well bore 62.

Figure 6:
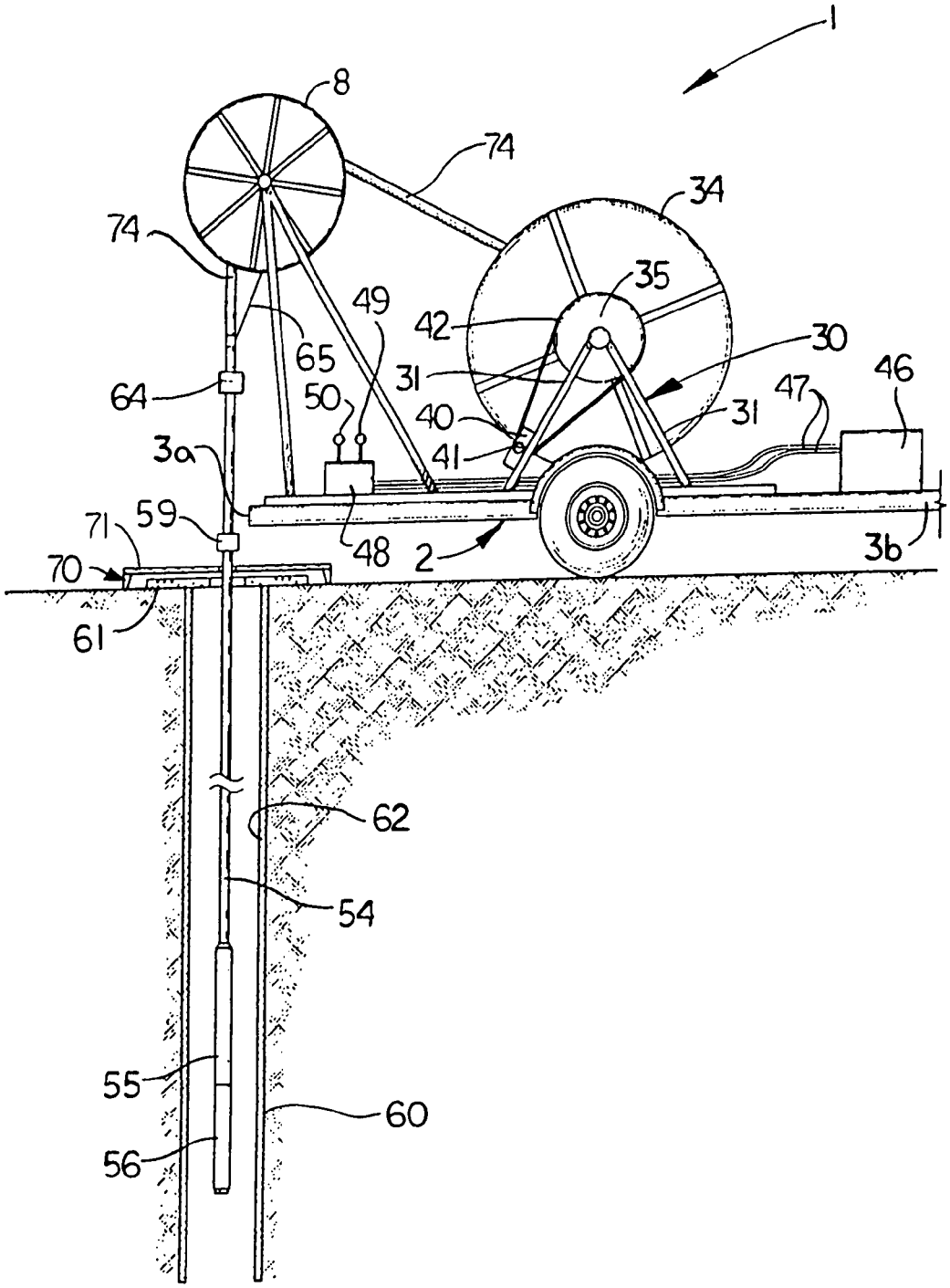
FIG. 6 is a side view of the transport, installation and removal apparatus, more particularly illustrating installation of the tubing string, pump and pump motor in a subterranean well bore preparatory to washing, cleaning, or testing of the well bore.

Referring next to FIG. 6 of the drawings, the apparatus 1 can be used in a well-cleaning operation to clean the well bore 62 of the well casing 60. Accordingly, the tubing string 54, pump 55 and pump motor 56 are lowered from the tubing spool 34 and tubing reel 8, into the well bore 62. A swivel connector 64 attaches the tubing string 54 to a flow line 74 which is connected to a supply of well cleaning fluid (not illustrated). A surface pump (not illustrated) is coupled to the flow line 74. The flow line 74 typically remains attached to the tubing reel 8 via a tether 65. Accordingly, the surface pump (not illustrated) is operated to pump the well cleaning fluid through the tubing string 54 and into the well bore 62 of the well casing 60. At the conclusion of the well-cleaning operation, the flow line 74 is detached from the tubing string 54 and the tubing string 54 is re-wound on the tubing spool 34.

Figure 10:
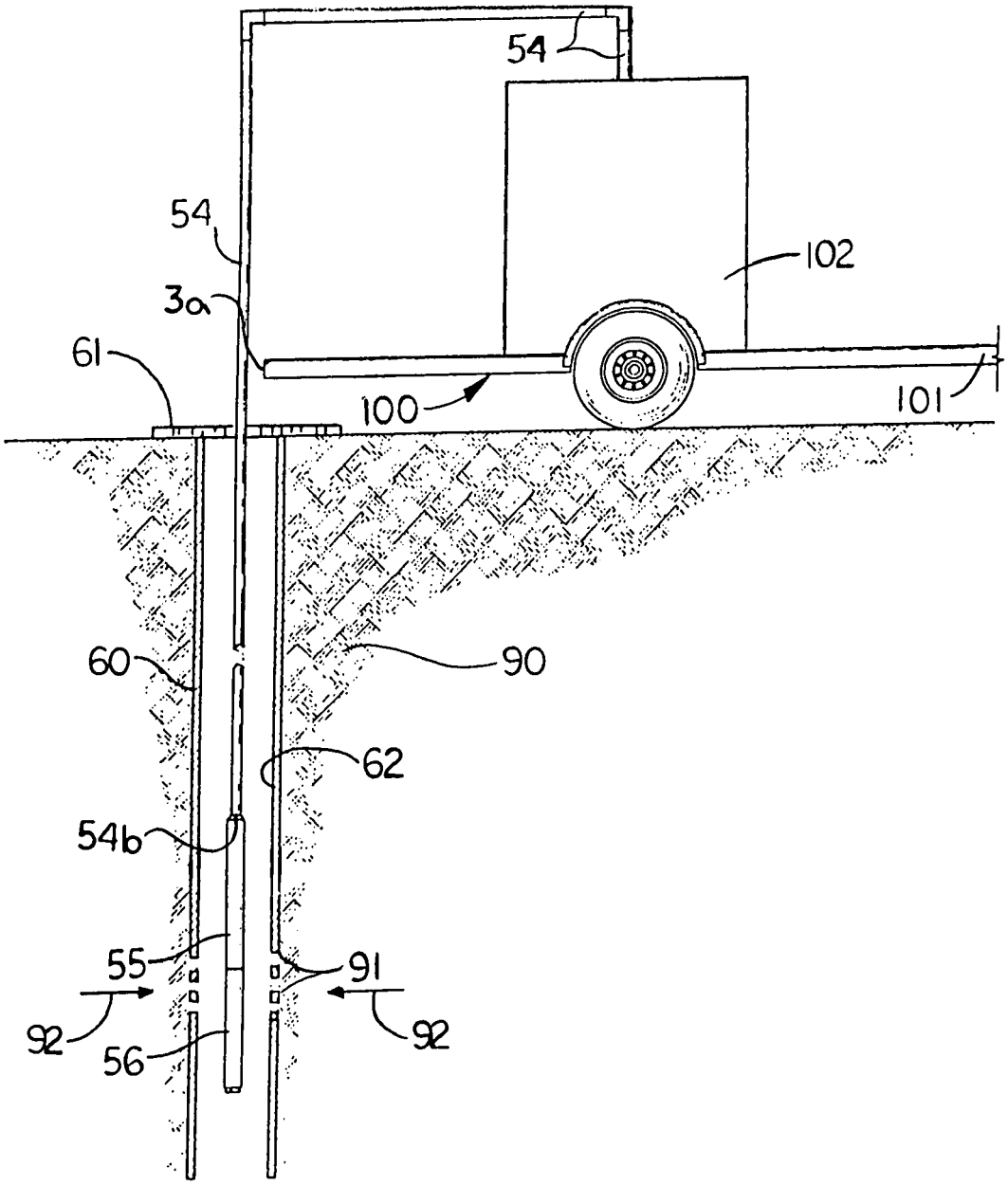
FIG. 10 is a side view of a trailer and a production tank provided on the trailer, with a tubing string, pump and pump motor extending into a subterranean well bore (in section) and the tubing string connected to the production tank for production of fluids from the well bore into the production tank.

Referring next to FIG. 10 of the drawings, in some applications of the fluid production system the tubing string 54, after deployment from the apparatus 1 typically as was heretofore described with respect to FIG. 5, is connected to a portable production tank 102 for production of the fluid 92 from the formation 90; through the pump 55 and the tubing string 54, respectively; and into the production tank 102. The production tank 102 may be provided on a wheeled trailer frame 101 of a trailer 100, for example. Accordingly, after the portable production tank 102 is filled to capacity with the fluid 92, the tubing string 54 is detached from the production tank 102 and again wound on the tubing spool 34 of the apparatus 1 and may be transported to another well bore 62 for deployment. The trailer 100 can be hitched to a towing vehicle (not illustrated) and the portable production tank 102 transported to a fluid storage, transportation or refinement facility (not illustrated).

Figure 11:
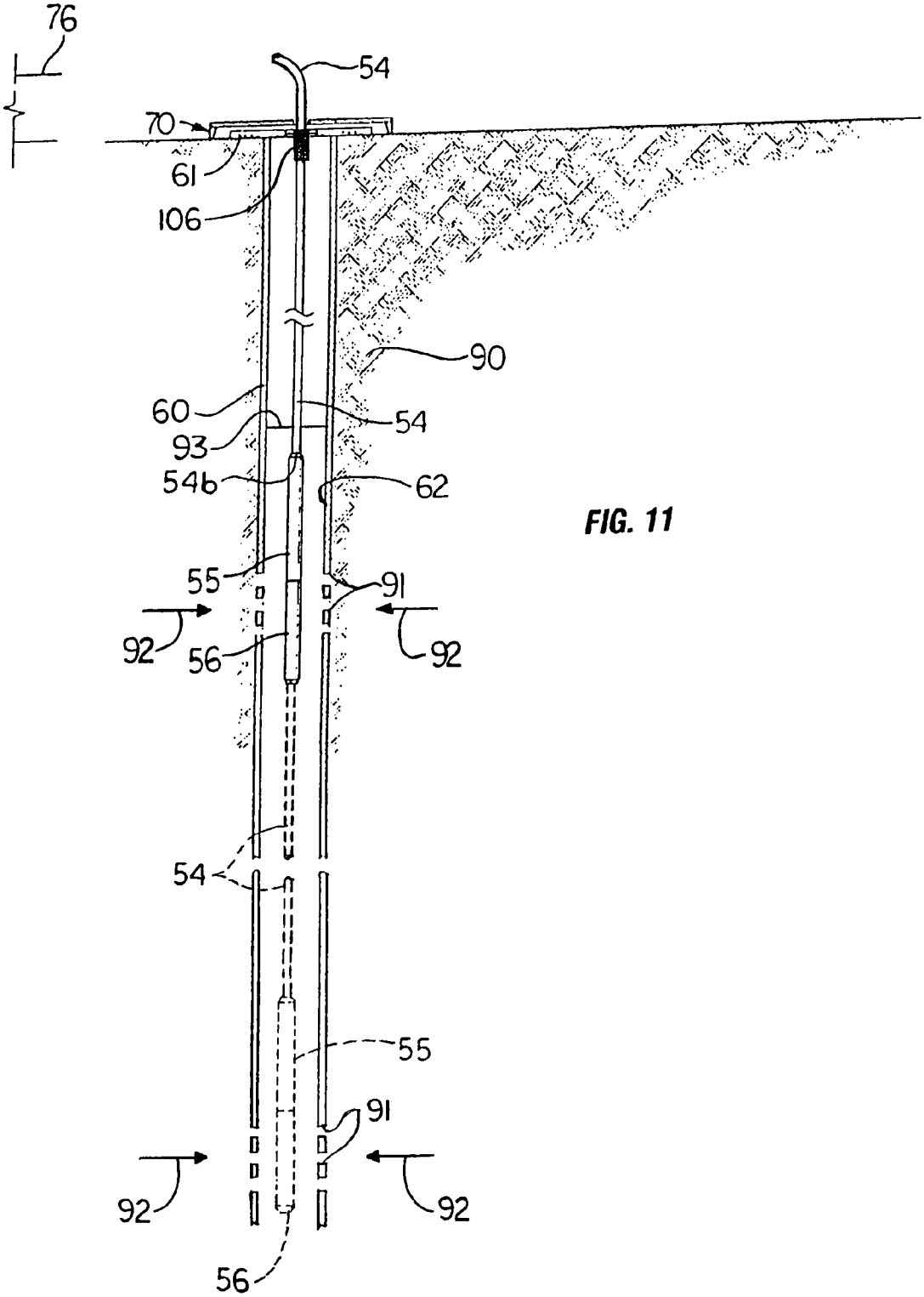
FIG. 11 is a sectional view of a subterranean well bore, with a tubing string, pump and pump motor extending into the well bore, more particularly illustrating a suspension sleeve provided on a well head and the tubing string extending through the suspension sleeve and further illustrating alternative depths of the pump and pump motor in the well bore.
Figure 12:
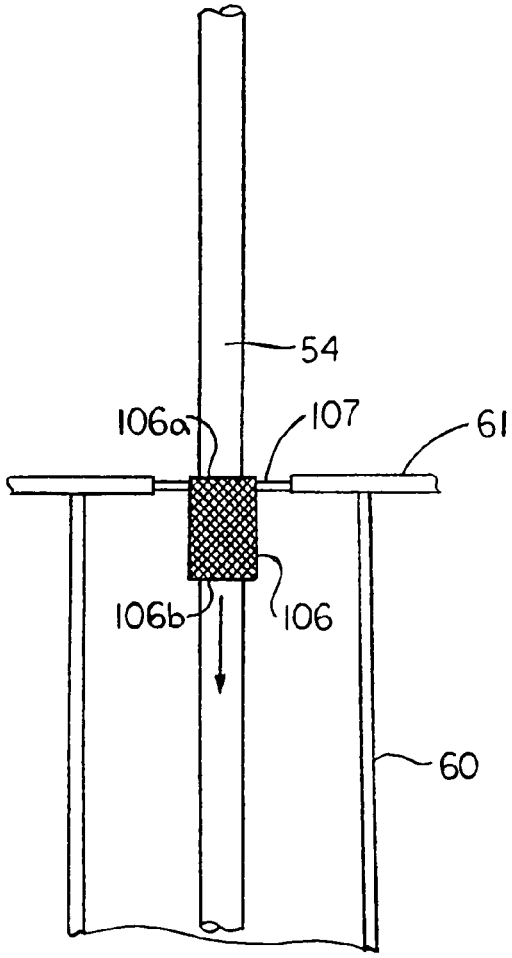
FIG. 12 is a side view, partially in section, of a well head, with a suspension sleeve provided on the well head and the tubing string extending through the suspension sleeve, more particularly illustrating lowering of the tubing string through the suspension sleeve when the suspension sleeve is disposed in a contracted configuration.
Figure 13:
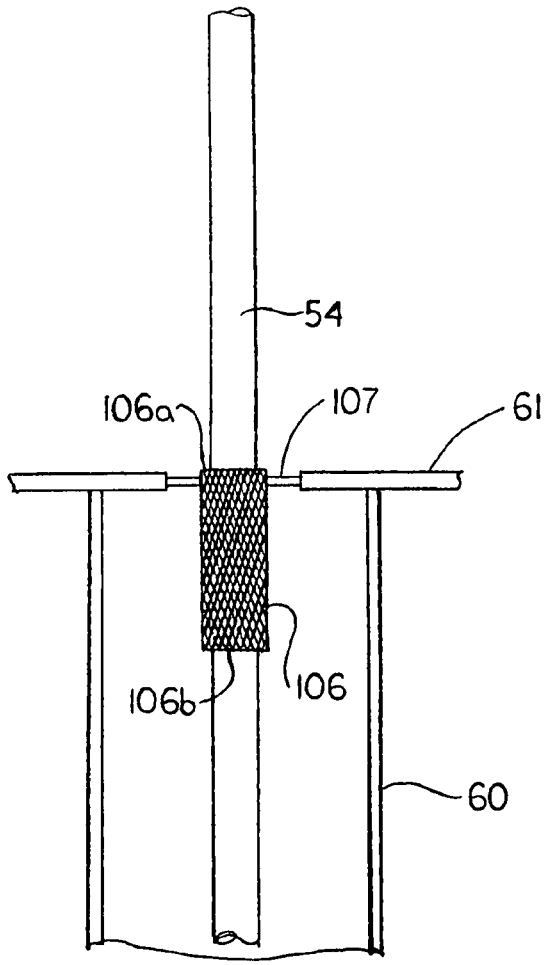
FIG. 13 is a side view, partially in section, of a well head, with a suspension sleeve provided on the well head and the tubing string extending through the suspension sleeve, with the suspension sleeve engaging and supporting the tubing string in the well bore when the suspension sleeve is disposed in an expanded configuration.

Referring next to FIGS. 11-13 of the drawings, in some applications of the fluid production system a suspension sleeve 106, having first and second sleeve ends 106*a* and 106*b*, respectively, is attached to the well head 61 using a suitable sleeve attachment member 107. The suspension sleeve 106 is an expandable wire mesh material and is similar in design to a Chinese Finger Trap. The tubing string 54 extends through the suspension sleeve 106. Accordingly, when the suspension sleeve 106 is deployed in the shortened configuration illustrated in FIG. 12, the first end 106*a* and the second end 106*b* of the suspension sleeve 106 expand and disengage the tubing string 54, facilitating extension or sliding of the tubing string 54 through the suspension sleeve 106. When the suspension sleeve 106 is deployed in the extended configuration illustrated in FIG. 13, the first end 106*a* and the second end 106*b* of the suspension sleeve 106 contract and engage the tubing string 54, setting and preventing further extension of the tubing string 54 through the suspension sleeve 106. Therefore, as illustrated in FIG. 11, by extension of a selected length of the tubing string 54 through the suspension sleeve 106 and then setting the tubing string 54 in the suspension sleeve 106, the pump 55 and pump motor 56 can be placed at a selected depth beneath the fluid level 93 in the well bore 62. This facilitates control over the rate of drawdown of the fluid level 93 and thus, the rate of production of the fluid 92 through the pump 55.

Figure 20:
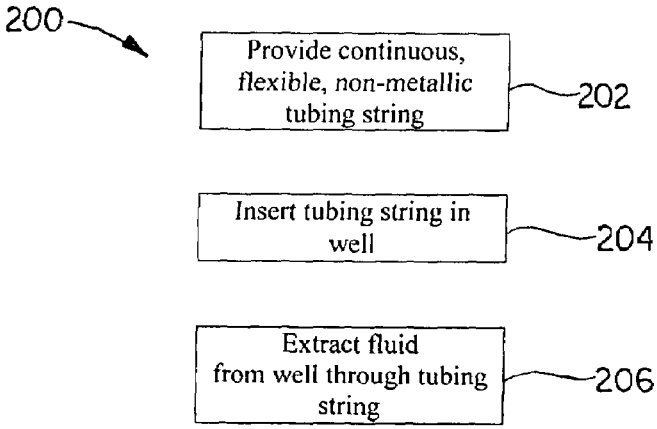
FIG. 20 is a flow diagram which illustrates an illustrative embodiment of a fluid production method.
Figure 21:
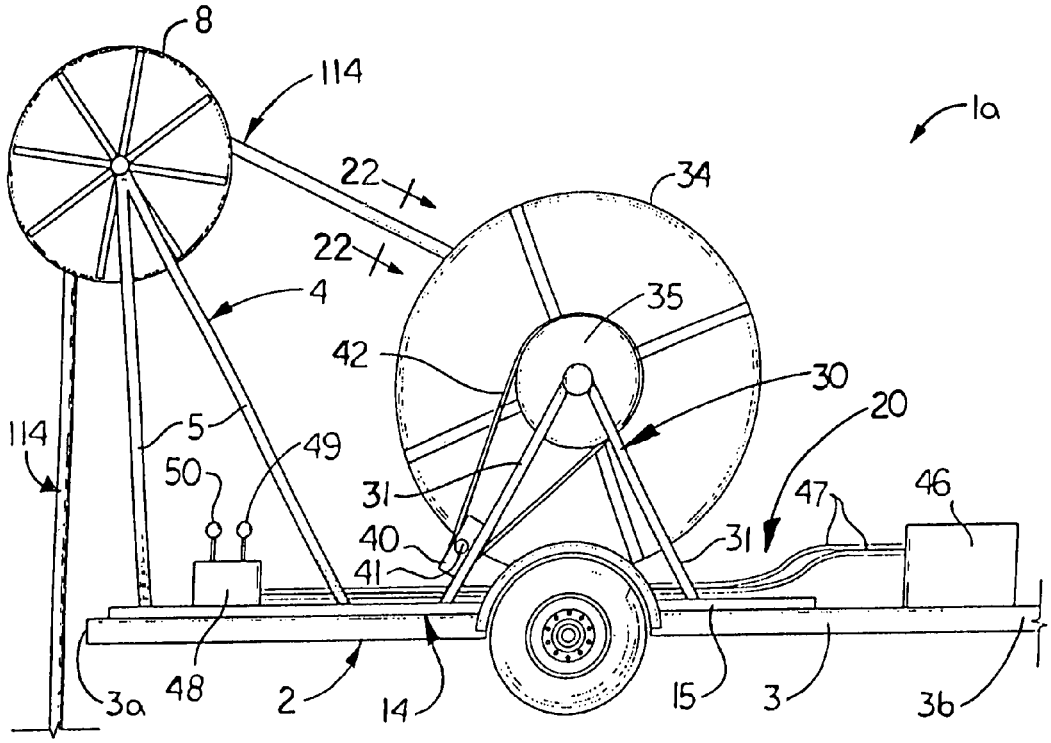
FIG. 21 is a side view of an illustrative embodiment of a transport, installation and removal apparatus of the fluid production system, with an internal spiral wiring configuration tubing string (partially in section) extending from a tubing spool element and over a tubing reel element of the apparatus.

Referring next to FIG. 20 of the drawings, a flow diagram which illustrates an illustrative embodiment of the fluid production method is generally indicated by reference numeral 200. In block 202, a continuous, flexible, non-metallic tubing string is provided. In block 204, the tubing string is inserted in a well. In block 206, fluid is extracted from the well through the tubing string. In some embodiments of the method, a pump is provided on the tubing string and a pump motor is provided in driving engagement with the pump. The fluid is extracted from the well through the tubing string by operation of the pump motor and the pump.

In some embodiments of the method, a tubing transport, installation and removal apparatus is provided. The apparatus includes a trailer having a wheeled trailer frame, a tubing spool carried by the trailer frame, a tubing reel carried by the trailer frame in spaced-apart relationship with respect to the tubing spool, a pump provided on the tubing string and a pump motor drivingly engaging the pump. The tubing string is inserted in the well by extending the tubing string from the tubing spool, over the tubing reel and into the well.

In some embodiments of the method, the tubing string includes a tubing string wall and multiple reinforcing cables extending through the tubing string wall. A well head may be provided over the well and an expandable wire mesh suspension sleeve provided on the well head. The tubing string is inserted into the well through the wire mesh suspension sleeve.

In some embodiments of the method, a channel plate having a channel slot is placed over the well. A tubing collar is provided on the tubing string. The tubing string is suspended in the well by inserting the tubing string in the channel slot and supporting the tubing collar on the channel plate.

In some embodiments, the method extracting fluid from a well includes providing a tubing transport, installation and removal apparatus including a trailer having a wheeled trailer frame; a tubing spool provided on the trailer frame; a tubing reel provided on the trailer frame in spaced-apart relationship with respect to the tubing spool; a pump provided on the tubing string; and a pump motor drivingly engaging the pump. A continuous, flexible and non-metallic tubing string is wound on the tubing spool. The tubing string is inserted in the well by unwinding the tubing string from the tubing spool, over the tubing reel and extracting fluid from the well through the tubing string by operation of the pump motor and the pump.

Figure 22:
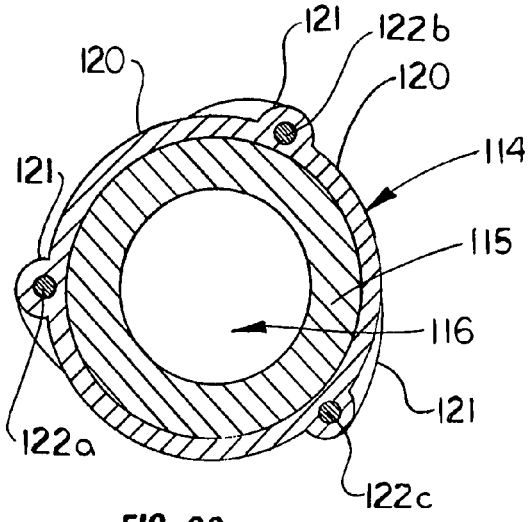
FIG. 22 is a cross-sectional view, taken along section lines 22-22 in FIG. 21, of the internal spiral wiring configuration of the tubing string.
Figure 23:
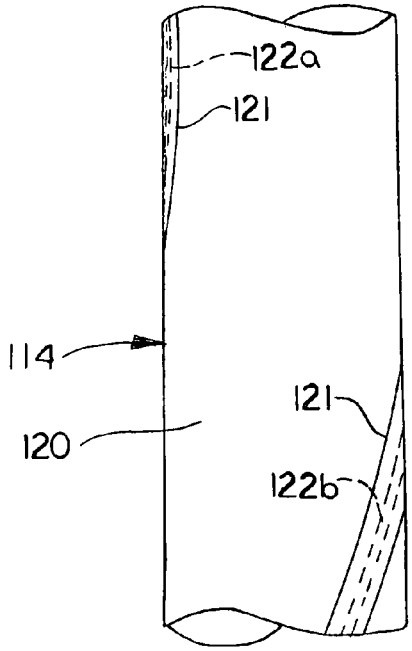
FIG. 23 is a side view, partially in section, of the internal spiral wiring tubing string.
Figure 24:
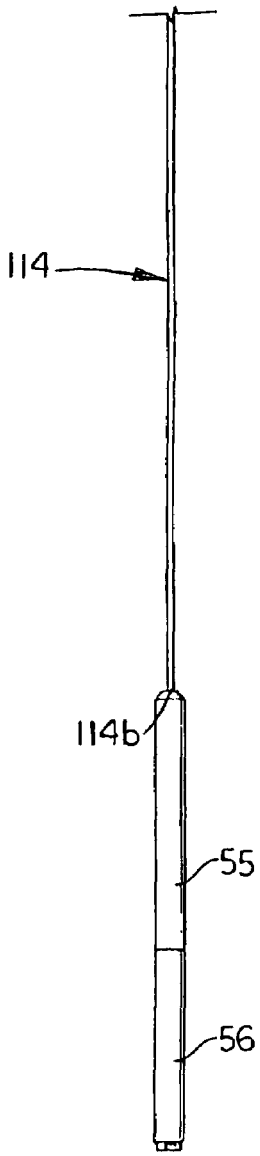
FIG. 24 is a side view of a segment of the internal spiral wiring tubing string (partially in section), with a pump and pump motor provided on the end of the segment of the tubing string.
Figure 25:
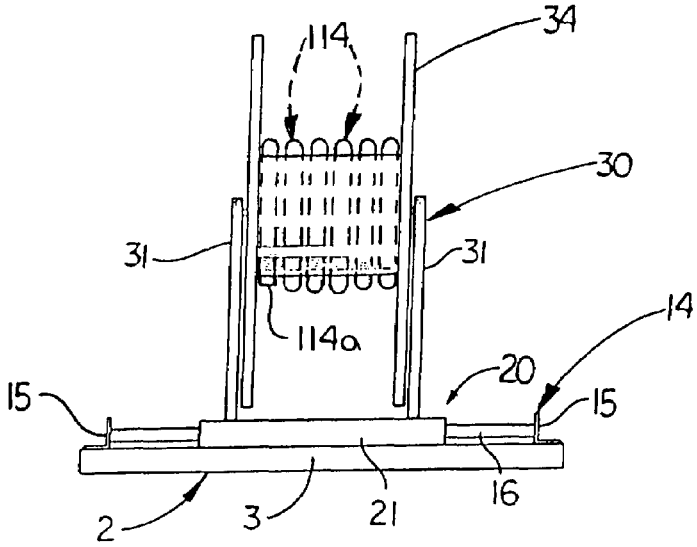
FIG. 25 is a front view of a tubing spool and spool carriage elements of the transport, installation and removal apparatus, with the internal spiral wiring tubing string would on the tubing spool.

Referring next to FIGS. 21-25 of the drawings, a tubing transport, installation and removal apparatus 1*a* which utilizes a tubing string 114 having an internal spiral or helical wiring configuration is illustrated. The apparatus 1*a* may have a design and function which are similar to the design and function of the apparatus 1 which was heretofore described with respect to FIG. 1. The spiral wiring tubing string 114 is wound on the tubing spool 34 and trained over the tubing reel 8 of the apparatus 1*a*, typically in the same manner as was heretofore described with respect to the tubing string 54 of the apparatus 1. The spiral wiring tubing string 114 has a proximal end 114*a* (FIG. 25), which corresponds to the portion of the spiral wiring tubing string 114 wound on the tubing spool 34, and a distal end 114*b* (FIG. 24). A submersible pump 55, drivingly engaged by a pump motor 56, is provided on the distal end 114*b* of the spiral wiring tubing string 114. At least one pump motor wiring cable 122 (FIG. 22) is electrically connected to the pump motor 56 and runs along the spiral wiring tubing string 114, typically in a manner which will be hereinafter described. The at least one pump motor wiring cable 122 is connected to a suitable power supply 63 (FIG. 19), such as a battery provided on the trailer frame 3 of the trailer 2 of the apparatus 1*a*, for example, as was heretofore described with respect to the pump motor wiring cable 57 of the apparatus 1 (FIG. 19).

As illustrated in FIG. 22, the spiral wiring tubing string 114 may include a tubular tubing core 115 having a tubing interior 116. An outer tubing layer 120 surrounds the tubing core 115. The outer tubing layer 120 may be high-durometer polyurethane, for example and without limitation. At least one wiring sheath 121 is provided in the outer tubing layer 120 and extends along the longitudinal dimension of the spiral wiring tubing string 114 in a spiral pattern, as illustrated in FIG. 23. Each wiring sheath 121 may protrude from the outer surface of the outer tubing layer 120, as further illustrated in FIG. 22. A pump motor wiring cable 122 extends through each wiring sheath 121. As illustrated in FIG. 22, in some embodiments three spiraled wiring sheaths 121 are provided in the outer tubing layer 120. The wiring sheaths 121 may be disposed in 120-degree relationship and may be generally parallel with respect to each other. A first pump motor wiring cable 122*a*, a second pump motor wiring cable 122*b* and a third pump motor wiring cable 122*c* extend through the spiraled wiring sheaths 121, respectively. In an exemplary method of fabrication, the tubing core 115 may be initially formed using an extrusion molding process. The outer tubing layer 120 and pump motor wiring cables 122 may then be extruded onto the tubing core 115 in a second extrusion pass.

In typical application of the apparatus 1*a*, the tubing spool 34 is rotated to unwind the spiral wiring tubing string 114 from the tubing spool 34, over the tubing reel 8 and lower the submersible pump 55 and pump motor 56 into the well bore 62 as was heretofore described with respect to operation of the apparatus 1 in FIG. 5. When the submersible pump 55 reaches the level of the standing fluid level 93 (FIG. 7) in the well casing 60, the spiral wiring tubing string 114 may be completely unwound from the tubing spool 34 and may remain tethered to the tubing reel 8, after which the spiral wiring tubing string 114 is detached from the tubing reel 8. As was heretofore described with respect to FIG. 19, the submersible pump 55 is electrically connected (through the at least one pump motor wiring cable 122) to a suitable power supply 63 which is provided typically on the trailer 2 or at an alternative location. As was heretofore described with respect to the tubing string 54 in FIG. 7, the spiral wiring tubing string 114 may be fitted with a tubing collar 59 and inserted in a channel slot 72 of a channel plate 70; a T-connector 75 may be provided on the proximal end 114*a* of the tubing string 114; a flow line 74 may be connected to the T-connector 75; and a collection tank 76 may be connected to the flow line 74. By operation of the submersible pump 55, fluid 92 is drawn from the formation 90, through the perforations 91 and into the well bore 62, from which the fluid 92 is drawn through the pump 55, spiral wiring tubing string 114, T-connector 75, flow line 74 and into the collection tank 76, respectively. It will be appreciated by those skilled in the art that the spiral or helical configuration of the at least one pump motor wiring cable 122 on the spiral wiring tubing string 114 transmits tensile loads which are placed on the spiral wiring tubing string 114 into circumferential loads. This causes the spiral wiring tubing string 114 to act as a torsion bar, significantly enhancing durability of the spiral wiring tubing string 114 and the capability of the spiral wiring tubing string 114 to resist tensile forces which are transmitted along the longitudinal dimension of the spiral wiring tubing string 114 during insertion and extraction of the submersible pump 55 and pump motor 56 into and out of the well bore 62 as well as during extraction of fluid 92 from the well bore 62.

Figure 26:
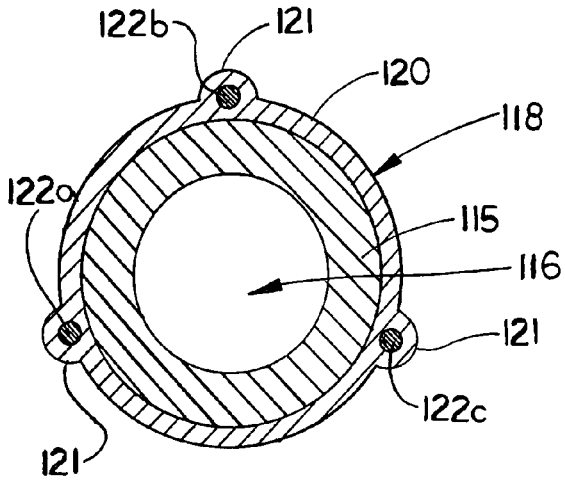
FIG. 26 is a cross-sectional view, taken along section lines 22-22 in FIG. 21, of an internal straight wiring configuration of the tubing string.
Figure 27:
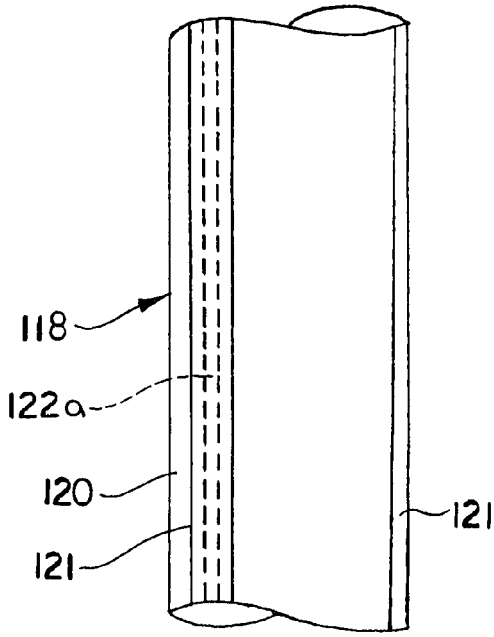
FIG. 27 is a side view, partially in section, of the internal straight wiring tubing string.

Referring next to FIGS. 26 and 27 of the drawings, an internal straight wiring configuration tubing string 118 is shown. In the internal straight wiring tubing string 118, at least one wiring sheath 121 is provided in the outer tubing layer 120 and extends along the longitudinal dimension of the spiral wiring tubing string 114 in a straight or axial configuration, as illustrated in FIG. 27. Accordingly, each wiring sheath 121 is oriented in generally parallel relationship with the longitudinal axis of the tubing string 118. Each pump motor wiring cable 122 extends through a wiring sheath 121. Use of the internal straight wiring tubing string 118 may be as was heretofore described with respect to the internal spiral wiring tubing string 114 in FIGS. 21-25.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A tubing string, comprising:

a tubing core having a tubing interior;

an outer tubing layer encircling said tubing core;

at least one wiring sheath provided in said outer tubing layer; and at least one wiring cable extending through and along said at least one wiring sheath.

2. The tubing string of claim 1 wherein said at least one wiring cable extends through said outer tubing layer in an axial configuration.

3. The tubing string of claim 1 wherein said at least one wiring cable extends through said outer tubing layer in a spiral configuration.

4. The tubing string of claim 1 wherein said at least one wiring sheath comprises a plurality of wiring sheaths and wherein said at least one wiring cable comprises a plurality of wiring cables extending through said plurality of wiring sheaths, respectively.

5. The tubing string of claim 4 wherein said plurality of wiring sheaths are disposed in 120-degree relationship with respect to each other.

6. The tubing string of claim 4 wherein said plurality of wiring sheaths are disposed in generally parallel relationship with respect to each other.

7. The tubing string of claim 1 wherein said at least one wiring sheath protrudes from an exterior surface of said outer tubing layer.

8. A tubing string, comprising:

a tubing core having a tubing interior;

an outer tubing layer encircling said tubing core;

at least one wiring sheath provided in said outer tubing layer;

at least one wiring cable extending through and along said at least one wiring sheath;

a submersible pump carried by said tubing core and said outer tubing layer; and a pump motor drivingly engaging said submersible pump.

9. The tubing string of claim 8 wherein said at least one wiring cable extends along said outer tubing layer in an axial configuration.

10. The tubing string of claim 8 wherein said at least one wiring cable extends along said outer tubing layer in a spiral configuration.

11. The tubing string of claim 8 wherein said at least one wiring sheath comprises a plurality of wiring sheaths and wherein said at least one wiring cable comprises a plurality of wiring cables extending through said plurality of wiring sheaths, respectively.

12. The tubing string of claim 11 wherein said plurality of wiring sheaths are disposed in 120-degree relationship with respect to each other.

13. The tubing string of claim 11 wherein said plurality of wiring sheaths are disposed in generally parallel relationship with respect to each other.

14. The tubing string of claim 8 wherein said at least one wiring sheath protrudes from an exterior surface of said outer tubing layer.

15. A fluid production system, comprising:

a tubing transport, installation and removal apparatus comprising:

a trailer having a wheeled trailer frame;

a tubing spool carried by said trailer frame;

a tubing reel carried by said trailer frame in spaced-apart relationship with respect to said tubing spool;

a tubing string wound on said tubing spool and extending over said tubing reel tubing string and comprising:

a tubing core having a tubing interior;

an outer tubing layer encircling said tubing core;

at least one wiring sheath provided in said outer tubing layer;

at least one wiring cable extending along and through said at least one wiring sheath in a spiral configuration;

a pump provided on said tubing string; and a pump motor drivingly engaging said pump.

16. The fluid production system of claim 15 wherein said at least one wiring cable comprises at least two wiring cables.

17. The fluid production system of claim 16 wherein said at least two wiring cables comprises at least three wiring cables.

* * * * *